US005950769A

United States Patent [19]

Barker et al.

[11] Patent Number: 5,950,769

[45] Date of Patent: Sep. 14, 1999

[54] BRIDGE RAILS FOR HORIZONTALLY MOVEABLE PASSENGER OR FREIGHT CAB

[75] Inventors: Frederick H. Barker, Bristol; Samuel C. Wan, Simsbury, both of Conn.

[73] Assignee: Otis Elevator Company, Farmington, Conn.

[21] Appl. No.: 09/023,309

[22] Filed: Feb. 13, 1998

[51] Int. Cl.[6] ..... B66B 17/22

[52] U.S. Cl. ..... 187/403; 187/249

[58] Field of Search ..... 187/403, 249, 187/401, 289, 394; 104/127, 129

[56] References Cited

U.S. PATENT DOCUMENTS 3,611,946 10/1971 Heximer et al. ..... 104/127

5,799,755 9/1998 Wan et al. ..... 187/403

*Primary Examiner*—Kenneth W. Noland

[57] ABSTRACT

Passenger or freight cabs 9 can roll on bridge rails 24, 25; 54, 55; 64, 65, between a pair of platforms such as an elevator car frame 19, a horizontal transport bogie 41, or a stationary platform 68. The bridge rails may move from a first position to a second position where they are parallel to, coaligned with and overlapping rails on one of the platforms so as to permit transferring a cab, either by individually rotating through corresponding axes passing through each rail, or by rotating a pair of such rails together about an axis passing between them.

6 Claims, 3 Drawing Sheets

FIG.4
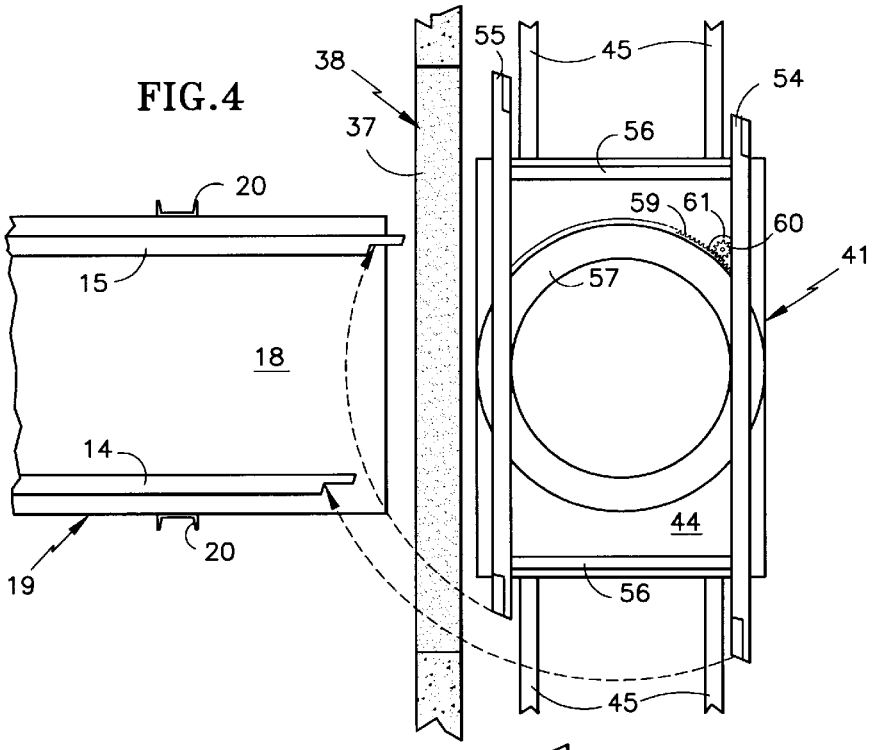
FIG.5
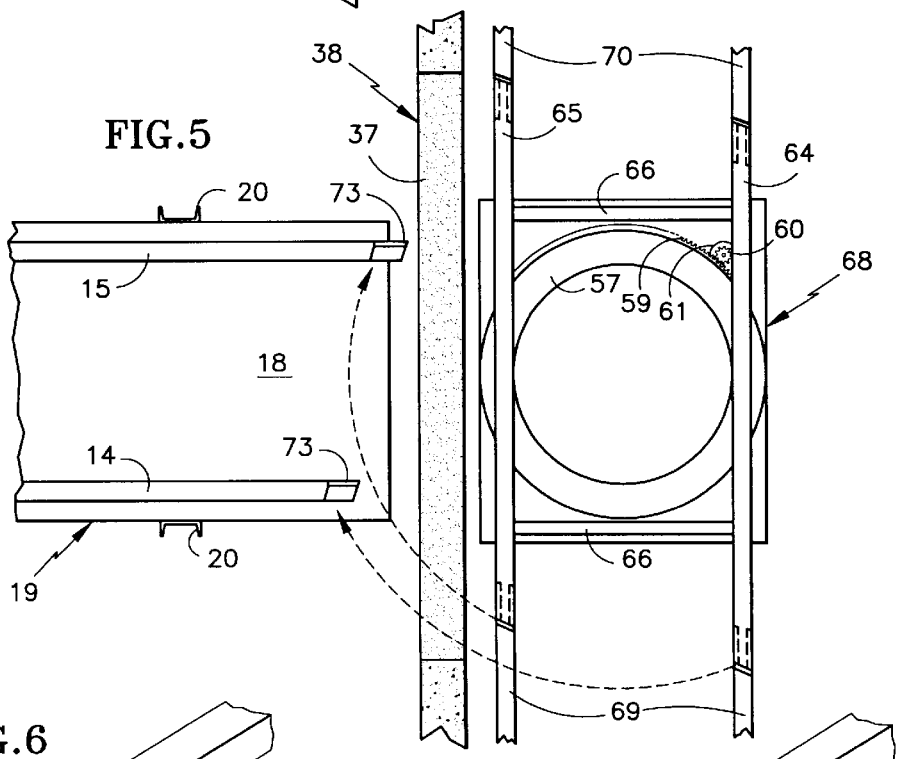
FIG.6
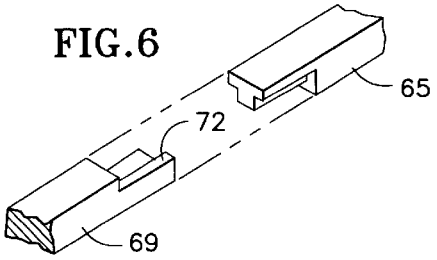
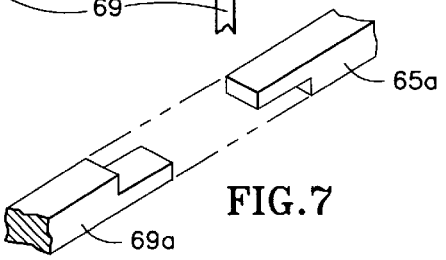
FIG.7

BRIDGE RAILS FOR HORIZONTALLY MOVEABLE PASSENGER OR FREIGHT CAB

TECHNICAL FIELD

This invention relates to bridge rails which permit cabs, such as passenger and freight cabs, to move from one platform, such as an elevator car frame, a horizontal transport bogie, a passenger landing, and the like, to another such platform of the same or a different type, including locking the platform against vertical motion.

BACKGROUND ART

Recent innovations in passenger travel in and around buildings, as well as incidental movement of freight, have provided transport systems employing cabs which can be transferred between a variety of locomotive devices. For instance, in U.S. patent application Ser. No. 08/749,296, filed Nov. 14, 1996, there is disclosed a system in which passengers can ride from an upper floor in one building downwardly to a ground level, and then horizontally for some distance, and then vertically in another building, all within the same passenger cab. In that case, the passenger cab is transferred from elevator car frames to horizontal transfer bogies and then to other elevator car frames. In such cases, the smooth transfer of the cab from one platform to another, such as from one car frame to another car frame, or from a car frame to a bogie, is essential for a successful system. In commonly owned, copending U.S. patent application Ser. No. 08/749,120, a system for transferring a cab between an elevator car frame and a bogie is disclosed. In that system, the bogie travels directly toward the elevator car frame, and thereby presents the tips of cab rails on the bogie directly into contact with tips of cab rails on the elevator car frame. However, in many applications, a bogie should travel across the front of an elevator hatchway, rather than into it. In such a case, the bogie cannot present its cab rails directly to the cab rails on an elevator car frame.

In U.S. Pat. No. 5,657,835, elevator cabs are transferred from an elevator car frame in a lower hoistway to an elevator car frame in a higher hoistway which is adjacent thereto. In that system, the cabs either simply roll across a sill, or they may be transferred by means of a rack and pinion arrangement disclosed therein. However, it would be preferable to provide rails for the cab to ride on. Of course, elevator car frames must have clearance between themselves and the adjacent building structures.

DISCLOSURE OF INVENTION

Objects of the invention include provision of bridge rails to support transfer of cabs from one platform to another, providing secure vertical positioning of platforms during transfer of elevator cabs thereto or therefrom, and accommodation of transfers between elevator car frames and horizontal transport bogies that travel past the elevator hatchway, but not into it.

According to the present invention, rails that support an elevator cab as it travels between a pair of adjacent platforms are moved between two positions so as to permit end-to-end alignment of the rails on one platform with other rails when transfer of a cab is desired, the rails being moved to provide clearance so that platforms can be moved, either vertically or horizontally. According to the invention in one form, bridge rails are disposed on a fixed structure, such as a building, each rail rotating about an axis which passes through the rail. According to the invention in another form, the rails may be disposed on a platform and rotated about an axis that lies between the rails; the platform in such case may be a moveable platform, such as an elevator car frame or a horizontal transport bogie, or it may be a stationary platform, such as disposed within a section of track of a self propelled cab.

In further accord with the present invention, the bridge rails of the present invention become wedged between structures of adjacent platforms, thereby providing secure vertical support to resist upward and downward movements of the adjacent platform.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 2 is an end elevation sectional view of interlaced rails, taken on the line 2—2 in FIG. 1.

FIG. 4 is a simplified, stylized, partially sectioned top plan view of bridge rails disposed for rotation on a horizontal transport bogie.

FIG. 5 is a simplified, stylized, partially sectioned top plan view of bridge rails disposed for rotation between tracks of a self propelled bogie and an elevator car platform.

FIGS. 6 and 7 are partial, perspective views of alternative forms of notches in the ends of the tracks.

BEST MODE FOR CARRYING OUT THE INVENTION

Figure 1:
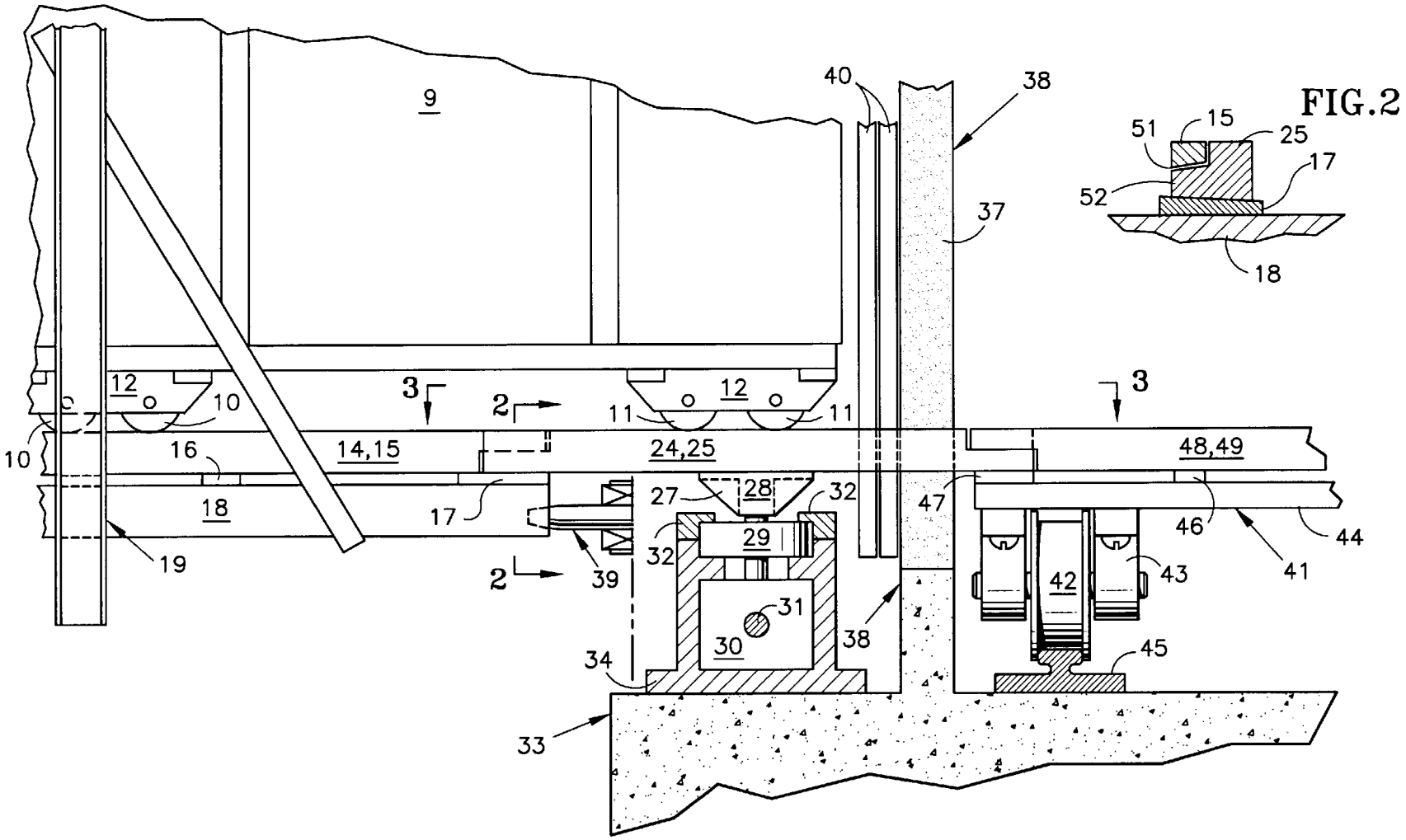
FIG. 1 is a partial, partially sectioned, stylized side elevation view of a cab being transferred between an elevator car frame and a horizontal transport bogie on bridge rails rotatably disposed on a building.
Figure 3:
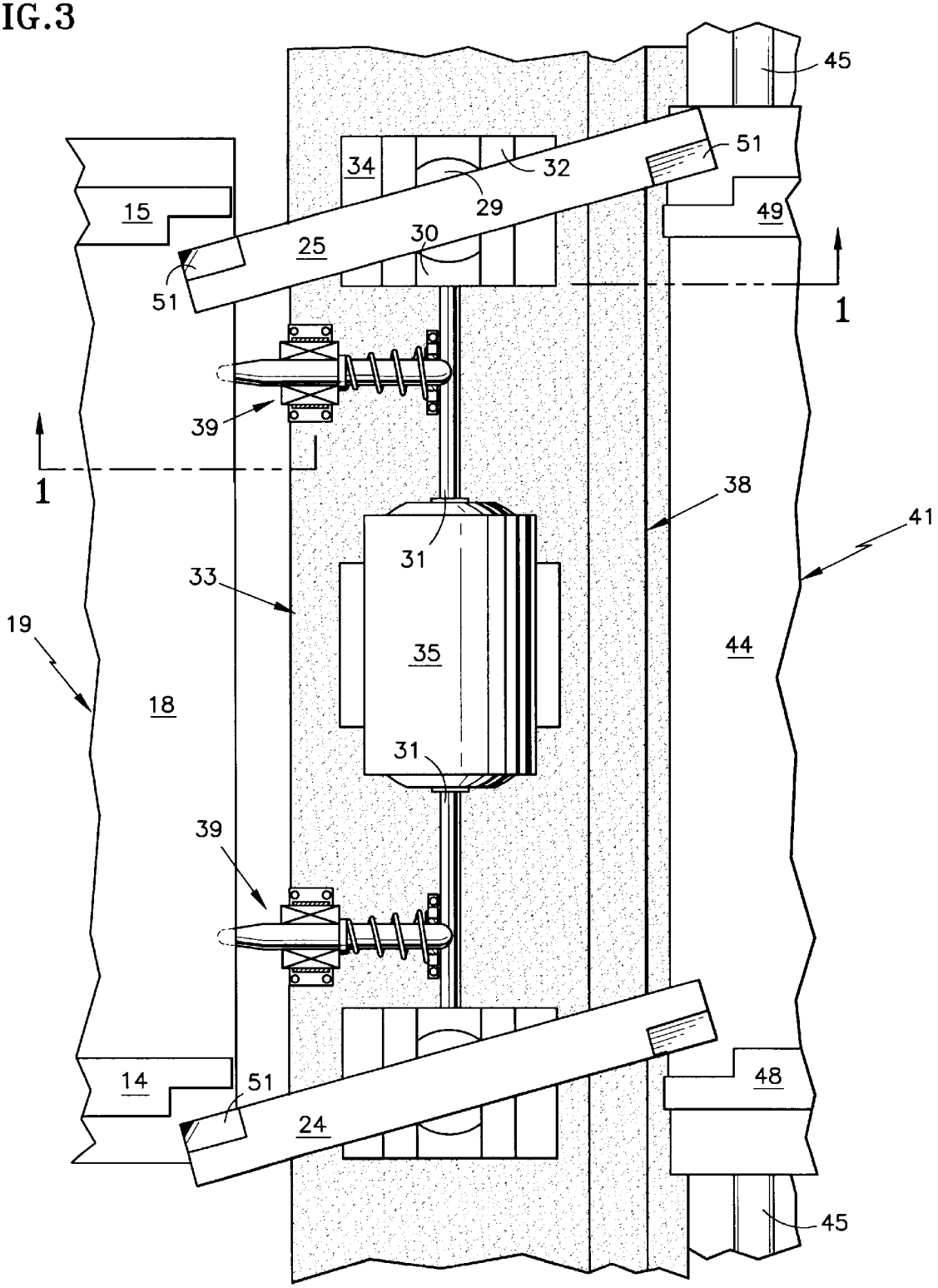
FIG. 3 is a partial, top plan of the rails and support structure, viewed from the lines 3—3 in FIG. 1.

Referring to FIGS. 1–3, a cab 9, which may be a passenger cab or a freight cab, has a plurality of wheels 10, 11 supported by suitable journals 12. The wheels 10 ride on rails 14, 15 which are supported by braces or brackets 16, 17 on a platform 18 of an elevator car frame 19 by means of the usual stiles 20 and braces 21. The wheels 11 are shown supported by bridge rails 24, 25, each of which is secured by a bracket 27 to a vertical shaft 28 which passes through a support bearing 29 to a gear box 30. The gear box 30 may contain a pair of bevel gears so as to convert driving motion of a horizontal shaft 31 to motion in the vertical shaft 28, in a well-known way. The bearings 29 and gear boxes 30 may be secured to any suitable structure of the building 33 by means of an appropriate frame 34 with any suitable fasteners (not shown). The bearing 29 is preferably a double, vertical thrust bearing that prevents the rails 24, 25 from rising or lowering. The bearing 29 is held in place by suitable keepers 32 secured to the frame 34 by suitable fasteners (not shown). The shaft 31 is driven by a suitable motor 35 (FIG. 3). Alternatively, since it is irrelevant whether the rails rotate in synchronism or not, each of the rails 24, 25 may be driven by its own motor.

To prevent the elevator car platform from rising due to rope stretch, after the bridge rails are rotated into the dormant position, parallel to the shaft 31, a car/floor lock 39 may be used, if desired.

The rails 24, 25 are shown extending through a hatchway 37 in a wall 38 of the building. Hatchway doors 40 of the usual variety may be provided to close the hatchway when not in use. Outside the hatchway, a horizontal transport bogie 41 has wheels 42 supported by suitable journals 43 to a platform 44. The wheels 42 roll on tracks 45, only one wheel and one track being shown in FIG. 1 for simplicity. Brackets 46, 47 support a pair of rails 48, 49 on the platform 44.

As seen in FIG. 2, the rails 14, 15, 48 and 49 are reduced to about one quadrant, and the rails 24, 25 have corresponding notches 51 formed therein, so as to permit the rails 24, 25 to overlap the rails 14, 15, and 48, 49 as well as becoming wedged between each of the rails and a corresponding bracket 17, 47. Thus, the rails 24, 25 will lock the car frame 19 in place to stabilize it vertically, thereby to compensate for rope stretch effects as the cab 9 moves onto the car frame 19 or as it moves off the car frame. The rails 24, 25 may have tapered surfaces as shown in FIG. 2 so as to provide a leading edge 52 of a reduced dimension, thereby to achieve adequate clearance for instance, between the rail 15 and the bracket 17 as the rail 25 is swinging into place.

Referring now to FIG. 4, another embodiment of the invention provides rails 54, 55 on a framework 56 that is supported by a lazy susan type of ball race 57 above the platform 44 of the bogie 41. The frame 56 may be rotated 90° by means of a sector gear 59 driven through a pinion 60 by a motor 61. To permit having overlapped rails of the type described with respect to FIGS. 1–3, the two rails 14, 55 that pass each other are made shorter at that end than the two rails 15, 54 that do not pass other rails. For symmetry, and to permit rotating clockwise, if necessary, to align with a car frame on the right side of the bogie 41, the rails 14 and 55 may be longer on the other end and the rails 15 and 54 may be shorter on their other ends. In other words, the rails are simply displaced by the amount of the desired overlap. In the arrangement of FIG. 4, the bogie can travel on the tracks 45 across the front of the hatchway 37, and then the frame 56 along with the rails 54, 55 will be rotated 90° so that the rail 15 is aligned with the rail 55 and the rail 14 is aligned with the rail 54. Then a cab can be transferred between the car frame 19 and the bogie 41.

In FIG. 5, a pair of rails 64, 65 are arranged on a frame 66 that is disposed on a stationary platform 68 so as to normally be aligned with main rails 69, 70 upon which a self-propelled cab (one that does not ride on a bogie) may travel from station to station. Self-propelled cabs can travel on the rails 69, 70 past the hatchway 37 without stopping, or they can travel on the tracks 69 until centered on the tracks 64, 65, and then stop. Then, as indicated by the dashed arrows in FIG. 5, the frame 66 and rails 64, 65 can be rotated 90° by apparatus 57–61 so as to place the tracks 64, 65 parallel to, coaligned with, and touching the tracks 14, 15, respectively.

In order to permit the rails 64, 65 to overlap and engage the rails 69, 70 while still being able to rotate into engagement with the rails 14, 15, the rails may have notches shaped as indicated in either FIG. 6 or FIG. 7. In FIGS. 5 and 6, the rails 69 have a small upwardly extending lip 72 on the right side thereof, while the rails 14, 15 and 70 have a similar lip 73 on the left or upper side thereof. The rails 65 are made to be complementary to both lips 70, 72 as shown in FIG. 6. Alternatively, all of the rails could simply have a half-thickness overlap as illustrated in FIG. 7.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A transport system comprising:

a passenger or freight cab supported on rollers;

a first platform selected from the group consisting of elevator car frame platforms, horizontal transport bogie platforms, and stationary platforms, said platform having a first pair of spaced apart rails to support the rollers of said cab and facilitate said cab moving horizontally with respect to the platform, said rails having notched ends;

a second pair of rails, said second pair of rails being moveable between a first position in which said second pair of rails are spaced from and perpendicular to said first pair of rails and a second position in which said second pair of rails are parallel to, coaligned with, and touching said first pair of rails, said second pair of rails having notched ends complementary to the notched ends of said first pair of rails so that said second pair of rails overlap with said first pair of rails when said second pair of rails are in said second position; and means for moving said second pair of rails between said first and second positions.

2. A system according to claim 1 wherein said second pair of rails are disposed in mutually parallel, spaced apart relationship on a platform, and are rotated between said first position and said second position about an axis which lies between said second pair of rails.

3. A system according to claim 2 wherein said platform is selected from the group consisting of horizontal transport bogie platforms and stationary platforms.

4. A system according to claim 2 wherein, when said second pair of rails is in said second position, a first one of said first pair of rails overlaps with a second one of said second pair of rails, and a second one of said first pair of rails overlaps with a first one of said second pair of rails, and said first rails extend outwardly from the center of said corresponding platform more than said second rails, whereby said second rail of said pair can pass said second rail of said first pair as said second pair of rails move from said first position to said second position.

5. A system according to claim 1 further comprising a second platform; and wherein said second pair of rails are disposed between said first and second platforms, and are rotated between said first position and said second position about corresponding axes which lie within each of said second rails.

6. A system according to claim 5 wherein said second platform is selected from the group consisting of elevator car frame platforms and horizontal transport bogie platforms.

* * * * *